US006058666A

United States Patent [19]

Lin

[11] Patent Number: 6,058,666

[45] **Date of Patent: *May 9, 2000**

[54] TWIN-AXIS PRESTRESSED SINGLE-TEE BEAM WITH LOWER FLANGE AND PROCESS OF CONSTRUCTION

[76] Inventor: Wei-Hwang Lin, Dept. Of Military Engr. Chinese Military Academy 830 R.O.C., Feng - Shan, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,103

[22] Filed: Aug. 31, 1997

[51] Int. Cl.[7] ..... E04C 5/08

[52] U.S. Cl. ..... 52/223.8; 14/6

[58] Field of Search ..... 52/223.8; 14/3, 14/4, 6–8, 13, 27

[56] References Cited

U.S. PATENT DOCUMENTS 4,710,994 12/1987 Kishida et al. ..... 14/1
4,912,794 4/1990 Thivans ..... 14/3
5,025,522 6/1991 Eskew et al. ..... 14/73
5,457,840 10/1995 Derechin ..... 14/73

*Primary Examiner*—Beth A. Stephan

[57] ABSTRACT

A twin-axis prestressed single-tee beam with lower flanges and process of construction is previded. The process includes construction of a cantilever prestressed beam and a simple-support prestressed beam. Both of them have a steel skeleton of roughly Y-shaped section including a pair of upward tilted flanges on the top and a pair of narrower flanges on the bottom. The steel skeleton of a cantilever prestressed beam has a flat top and a arcuate bottom, and the steel skeleton of a simple-support prestressed beam has an upwardly arcuate generally rectangular body. Pressures are applied to the upper and lower flange by a plurality of hydraulic presses, so as to force the skeletons to be deflected to become nearly straightened. Then mounts an outer mold conforming the outer shape of the skeletons prior to grouting the concrete. When the concrete is cured. The cantilever prestressed beam shall exert the resilient forces both along the longitudinal direction as well as the transverse direction and the simple-support prestressed beam exerts the resilient forces both along the longitudinal and transverse directions either. So that the downward pressure and the tension stress of the traffic load will be offset and/or obviated by these resilient forces.

18 Claims, 9 Drawing Sheets

PRIOR ART 10
13
12
16
14
15
11
3 – 3

TWIN-AXIS PRESTRESSED SINGLE-TEE BEAM WITH LOWER FLANGE AND PROCESS OF CONSTRUCTION

TITLE

Twin-axis prestressed single-tee beam with lower flange and process of construction.

BACKGROUND OF THE INVENTION

The present invention relates to prestressed beams and more particularly to a twin-axis prestressed single-tee beam and process of construction which includes two types of prestressed beams such as a cantilever type and a simple-support type and which provides a structure enabling the prestressed steel beam to exert twin-axis prestress toward both the longitudinal and transverse orientations.

To elongate the span in construction of a bridge or a stadium in order to lessen the piers or abutments, a prestressed concrete beam is thus adapted to exert the prestress against the downward pressure from the top, the tension on the bottom and the shears at two ends of the beam. Before building a bridge, the span has to be decided according to the distance between the banks of a river. The longest span of a bridge in history may be extended to one hundred meters. So that the beam must have adequate prestress against the aforediscussed pressure, tension and shear from the top, bottom and two ends of the beam which are subject to the dead load and traffic load. FIG. 1 shows a typical cantilever beam, at two ends of which the deflection yield because where the apply load are larger than the other parts of the beam and the heavier the traffic load, greater the deflection. However, if twin axis, presaddle is previously provided in the cantilever beam, this deflection at two ends of the beam will be offset. FIG. 2 shows a simple-support prestressed beam to which the piers or abutments are positioned at two ends of the beam so that the deflection at middle portion is larger than the other parts of the beam. To offset this deflection the structure of the simple support prestressed beam differs from the cantilever prestressed beam.

The present invention is arisen to militate and/or obviate the aforediscussed disadvantages and provides greater prestress to offset the deflection yielding in the prestressed beams.

SUMMARY OF THE PRESENT INVENTION

The present invention has a main object to provide a twin-axis prestressed single-tee beam with lower flanges and process of construction which can effectively obviate and/or offset the beam from creating excessive deflection on greater traffic load.

Another object of the present invention is to provide a twin-axis prestressed single-tee beam with lower flanges and process of construction which elongates the span of a bridge and widens the space between adjacent beams.

Still another object of the present invention is to provide a twin-axis prestressed single-tee beam with lower flanges and process of construction which is constructed with specific method for saving time and labour.

Further object of the present invention is to provide a twin-axis prestressed single-tee beam with lower flanges and process of construction which is connected with a specifically designed stretching link so as to provide greater stability and shock-proof to a bridge.

The present invention will become more fully understood by reference to the following detailed description thereof when read in conjunction with the attached drawings.

DETAILED DESCRIPTION OF THE PREFERRED EMBODIMENT

Figure 1:
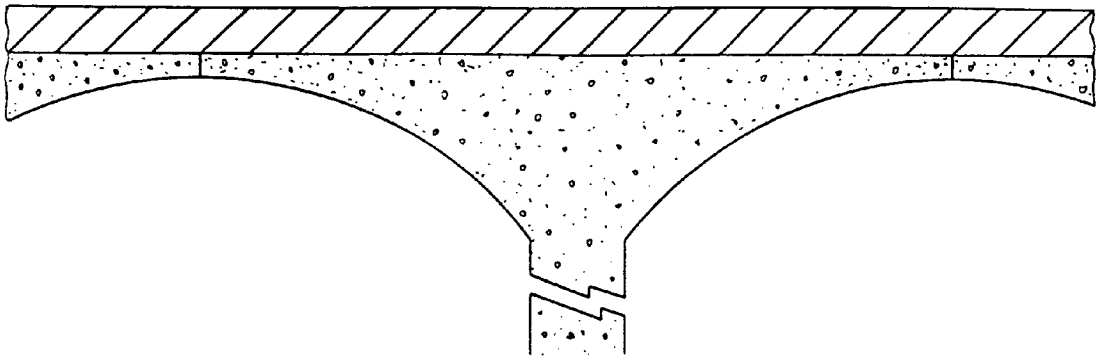
FIG. 1 is a sectional view illustrating a prior art bridge constructed by cantilever beams.
Figure 2:
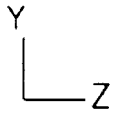
FIG. 2 PRIOR ART
FIG. 2 is sectional view illustrating a prior art bridge constructed by simple-support beams.
Figure 2:
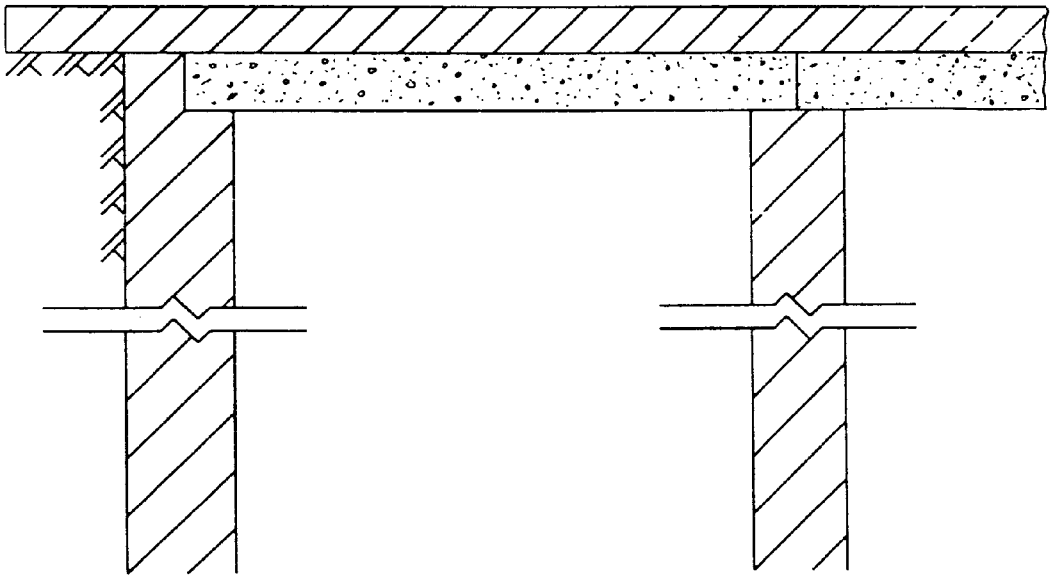
FIG. 2 PRIOR ART
Figure 2:
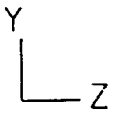
FIG. 2 PRIOR ART
Figures 3, 3A, 3B:
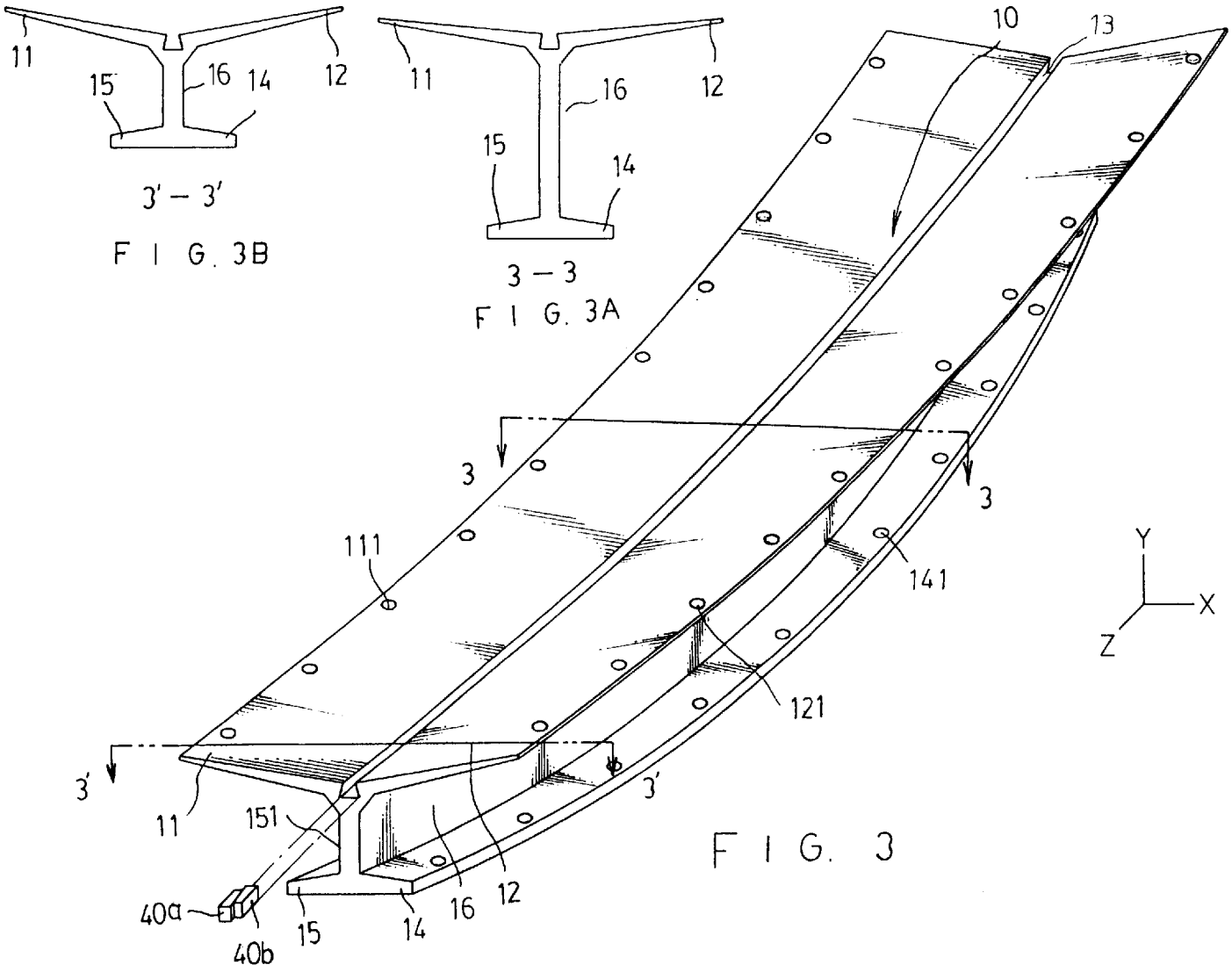
FIG. 3 is a perspective view showing a steel skeleton of a cantilever beam of the preferred embodiment of the present invention.
FIG. 3A is a sectional view taken along line 3—3 of FIG. 3.
FIG. 3B is a sectional view taken along line 3'—3' of FIG. 3, FIGS. 4 and 4A are the elevational views illustrating the application of the hydraulic presses to the steel skeleton of the cantilever prestressed beam according to the present invention.
Figures 4, 4A:
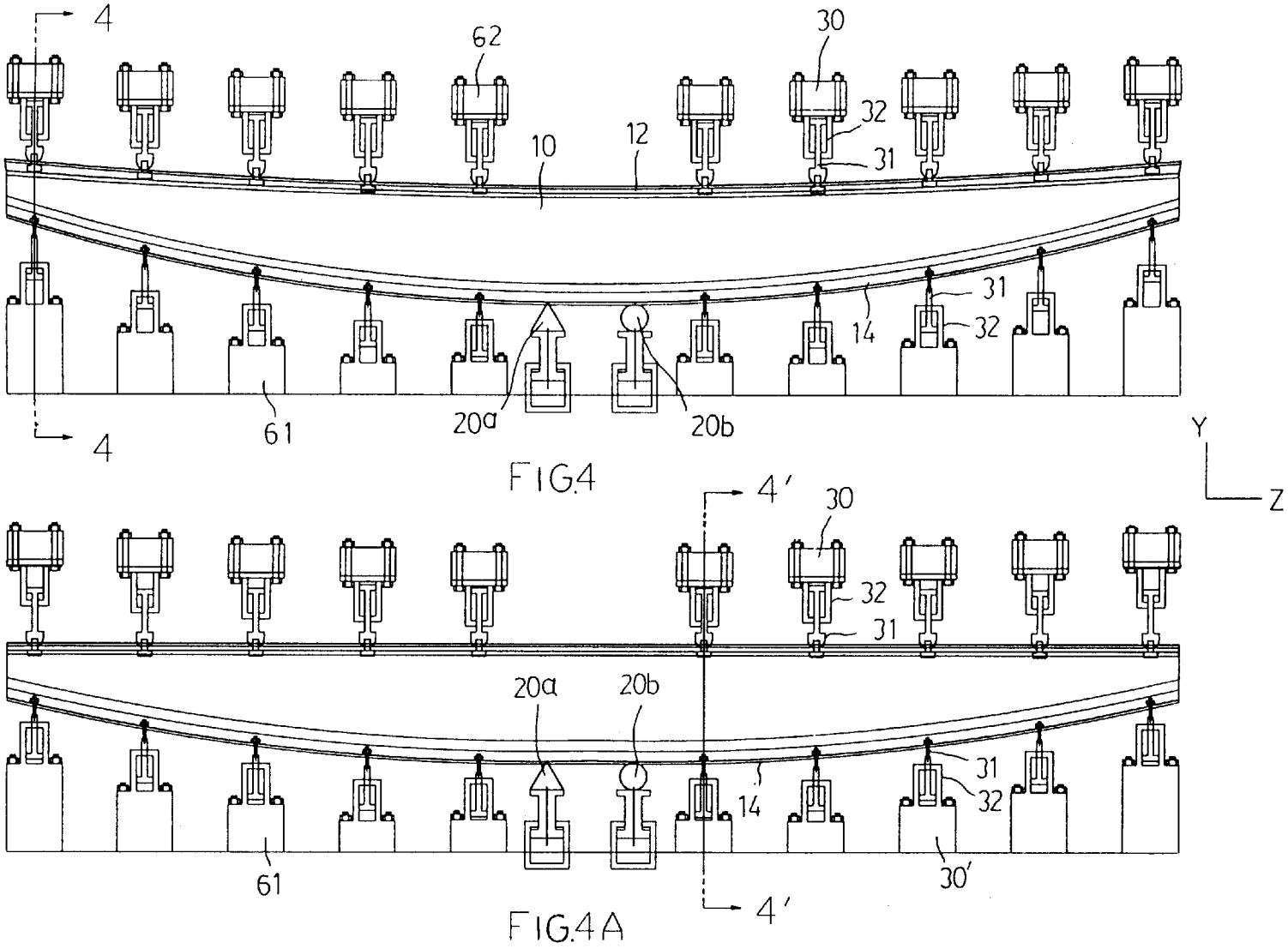

With reference to FIGS. 3, 3A and 3B, showing a steel skeleton of a cantilever prestressed beam of the present invention. The steel skeleton includes an elongate steel body 10 of roughly Y-shaped section, a pair of upper flanges 11 and 12 laterally extended from the center through the length of the body 10 and slightly tilted upward so as to define a saddle-backed upper surface for the body 10 wherein the flanges 11 and 12 abutting two ends thereof are more titled than the middle portion (as shown in FIG. 3B), a pair of lower flanges 14 and 15 which are narrower than the upper flanges 11 and 12 laterally extended from the center and along the length of the body 10, an upright portion 16 or web of arcuate lower end centrally connected between the upper and lower flanges 11, 12, 14 and 15 so as to define a bowed cross-section for the body 10 (as shown in FIG. 4), the lower end of the cantilever prestressed beam may substantially be oblique straight or parabolic lined and the lower surface of the upper flanges 11 and 12 may be flat or arcuate, and an elongate rectangular groove 13 centrally formed in the upper surface of the body 10 and extended along the length there of the body 10 for frictionally inserting with a plurality of pairs of wedge means 40*a* and 40*b* therein. The wedge means 40*a* and 40*b* each has a camming surface toward each other so that each pair of the wedge means 40*a* and 40*b* can be combined into a rectangular shaped block engageable into the rectangular groove 13 (as shown in FIG. 3). Each of the flanges 11, 12, 14 and 15 includes a plurality of the first and second spot face holes 111, 121, 141 and 151 formed spaced apart near their outward lateral edges and along the length of the body 10 for engagement with the forward ends of a plurality of the first and second hydraulic presses 30 and 30' (as shown in FIGS. 4, 4A). The hydraulic presses 30 and 30' are of conventional type and operated by ambient hydraulic sources and each includes a plunger means 31 slidably disposed in the cylinder body 32. The plunger means 31 of the first hydraulic presses 30 each has a threaded ball head 31*a* and the plunger means 31 of the second hydraulic presses each has a threaded recess 31*b* in the cylinder forward end (as shown in FIGS. 6 and 7).

Referring to FIGS. 4 and 4A and 5A to 5D of the drawings, by which the process of construction of the cantilever prestressed beam is described as follows:

First, parallel place the steel body 10 on a pair of hydraulic supports 20*a* and 20*b* which are support to the positions of the body 10 where the piers or abutments will be supported. The first hydraulic support 20*a* is a hinge and has a canical upper end and the second hydraulic support 20*b* is a roller and has a ball upper end. Then secure the second hydraulic presses 30' to the top of a plurality of lower frames 61 with pair off. The lower frames 61 which are made of steel of different heights are previously secured spaced apart to the base of the working site at the positions in alignment with the corresponding spot face holes 141 and 151 of the lower flanges 14 and 15 of the body 10 so as to facilitate releasably connecting the forward ends of the plunger means 31*b* to the corresponding spot face holes 141 and 151. Secondly, secure the first hydraulic presses 30 with pair off to the bottom of the upper frames 62 which are also made from steel and are precedingly secured to the upper ceil of the working site at the positions in alignment with the corresponding spot face holes 111 and 121 of the upper flanges 11 and 12 of the body so as to facilitate releasable connection of the ball heads 31*a* to their corresponding spot face holes 111 and 121. (as shown in FIGS. 4 and 4A and 5A, 5B).

Figure 6:
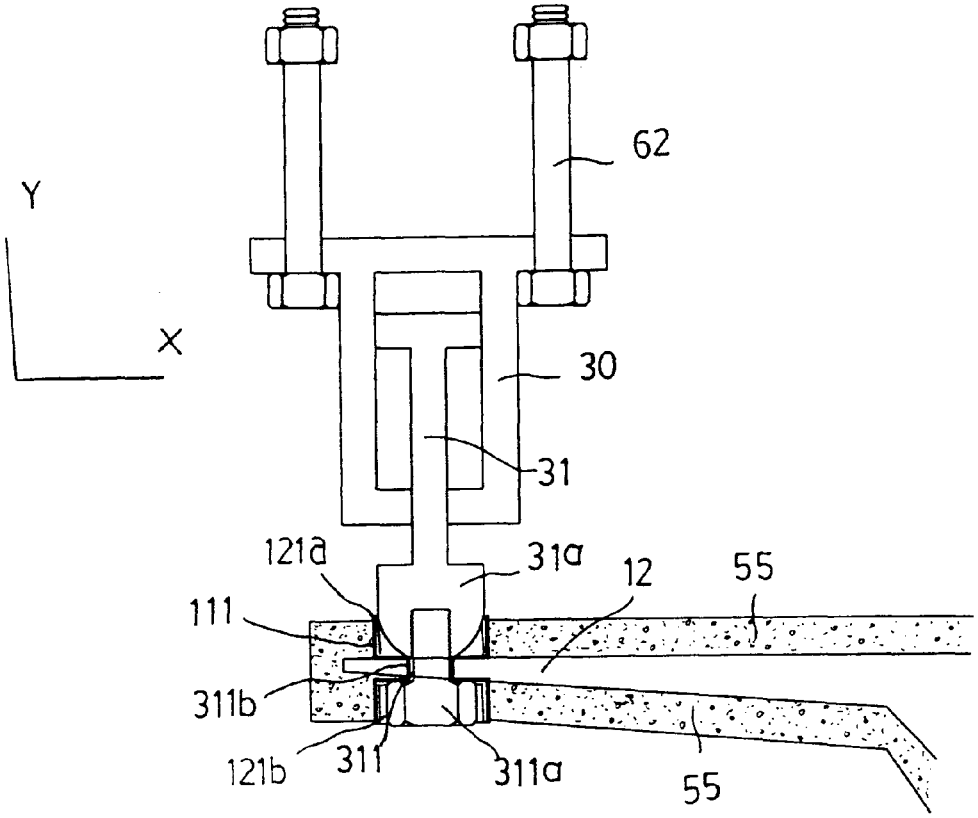
Figure 7:
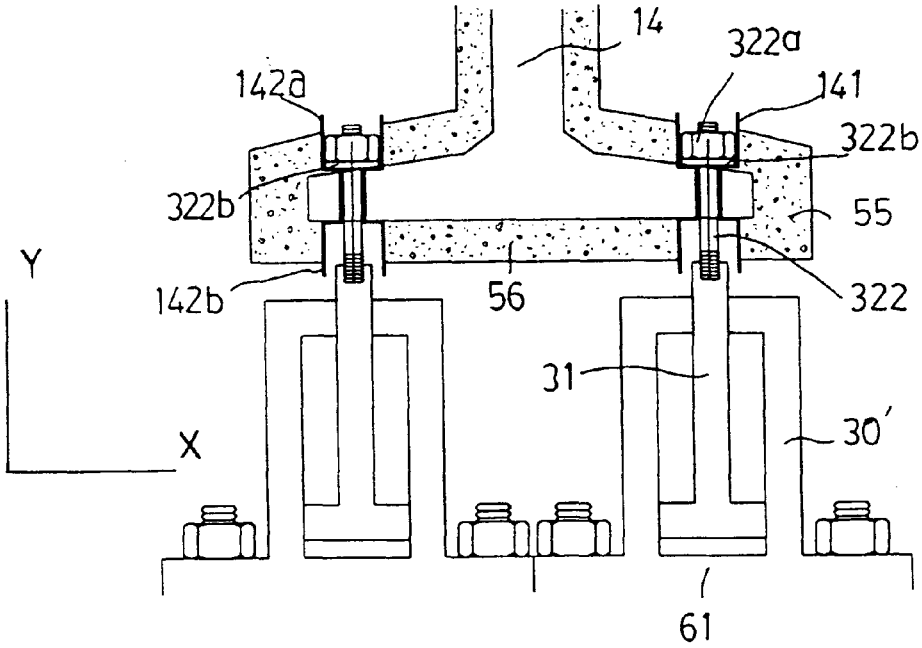

Referring to FIGS. 6 and 7 which illustrate the details of the connection of the plunger means 31 of the first and second hydraulic presses 30 and 30' to the corresponding spot face holes 111, 121, 141 and 151 of the upper and lower flanges 11, 12, 14 and 15. FIG. 6 shows that each of the spot face holes 111 and 121 adapts a pair of first and second retaining rings 121*a* and 121*b*. The first retaining ring 121*a* is partially embedded into the upper portion of the spot face holes 111 and 121 and releasably engageable with the ball heads 31*a* therein and the second retaining ring 121*b* is positioned abutting the lower portion of the holes 111 and 121 and releasable engageable with a round head 311*a* of a screw 311 which includes a threaded shank 311*b* inserting through the holes 111 and 121, the first retaining ring 121*a* and axially fastening into the threaded recess of the ball heads 31*a* of the first hydraulic presses 30. FIG. 7 shows that each of the spot face holes 141 and 151 also adapts a pair of third and fourth retaining rings 142*a* and 142*b*. The third retaining rings also partially embedded into the upper portion of the spot face holes 141 and 151 and each receivable within a nut 322*a* and washer 322*b*.

The fourth retaining ring 142*b* wraps on the forward end of the plunger means 31 of the second hydraulic presses 30' and positioned against the lower portion of the holes 141 and 151, a threaded retaining pin 322 is inserted through each of the holes 141 and 151 from the top of the holes 141 and 151 and axially fastened into the threaded recess in the forward ends of the plunger means 31 of the second hydraulic presses 30', and the upper end of the retaining pin 322 is fastened by the nut 322*a* with the washer 322*b* engaged therebetween.

Figure 5A:
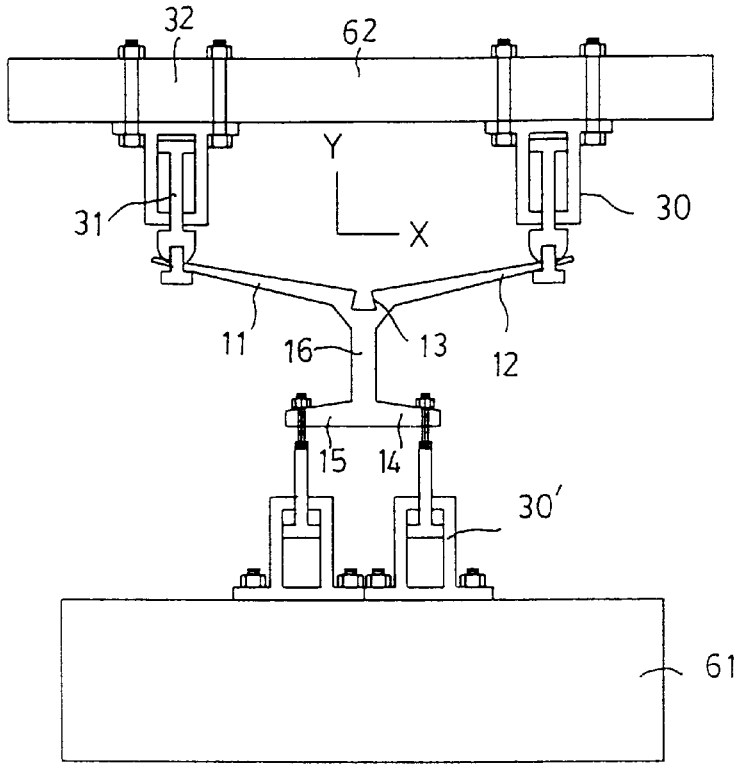
FIGS. 5A to 5D are the different sectional views illustrating the process for construction of a cantilever beam according to the present invention, wherein 5A is taken from 4—4 of FIGS. 4 and 5B to 5D are taken from 4'—4' of FIG. 4, FIGS. 6 and 7 are the sectional views to show the details of the application of the hydraulic presses to the flanges of the prestressed beams.
Figure 5B:
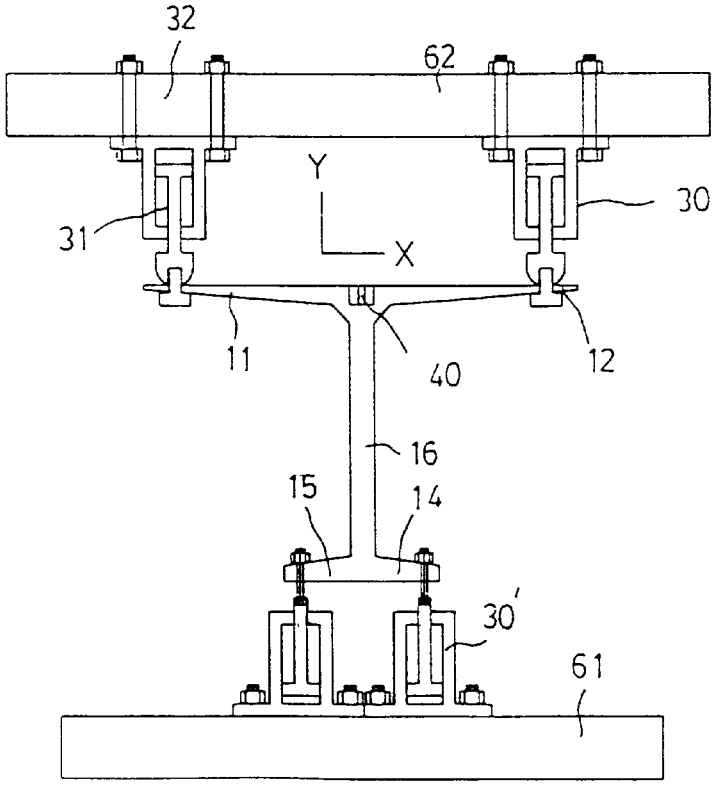
Figure 5C:
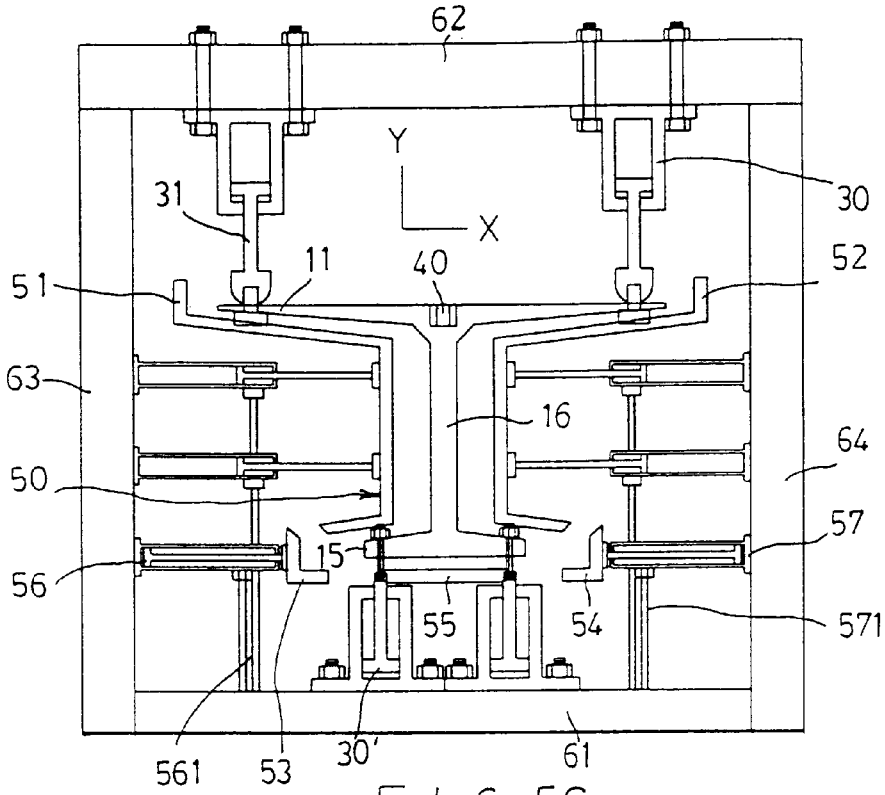
Figure 5D:
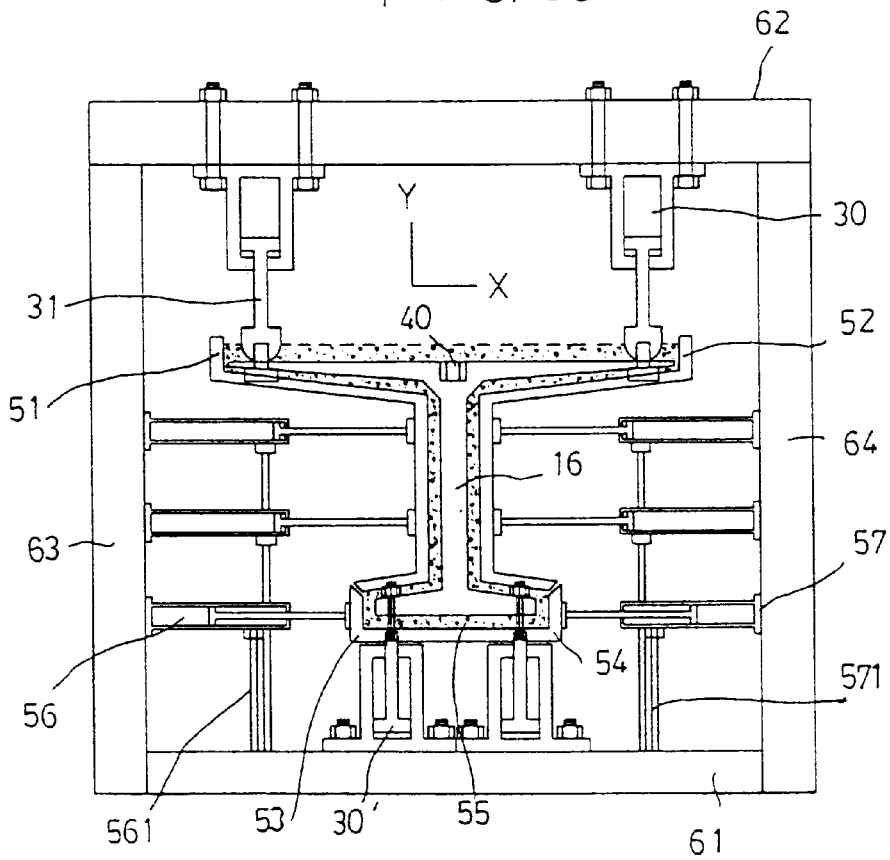

When the cantilever steel body 10 is stably engaged with the first and second hydraulic presses 30 and 30' (as shown FIGS. 4 and 4A), it comes up the operational process. The first step of the process is to apply the pressure to the upper flanges 11 and 12, the lower flanges 14 and 15 and the arcuate portion of the cantilever steel body 10 by gradually applying predetermined hydraulic pressures into the first and second hydraulic presses 30 and 30' and the first and second supports 20*a* and 20*b*, so that the plunger means 31 of the first and second hydraulic presses 30 and 30' and the hinge and the roller of the first and second supports 20*a* and 20*b* are worked in concert to force the body 10 to be deflected until that the transversely saddle backed upper surface of the cantilever steel body 10 became flat and its longitudinally arcuate lower end became appropriately straightened (as shown in FIGS. 5A and 5B). Since the elongate rectangular groove 13 in the top of the body 10 became widened also. This time, frictionally insert a predetermined number of the wedge means 40*a* and 40*b* with pair off into the groove 13 and weld them immediately so as to obviate partially the concentration stress when the first hydraulic presses 30 are removed. FIG. 5C shows a second step in which an outer mold 50 is adapted to spacedly mount upon the outside of the body 10. The mold 50 is made of steel conformable with the deflected shape of the body 10 and includes a pair of first and second lateral portions 51 and 52, a pair of first and second corner portions 53 and 54 and a lower portion 55. Each of them has the length equal to the length of the body 10. Both the first lateral portion 51 and the first comer portion 53 are previously fixed to a plurality of third hydraulic presses 56 which are in turn fixed to a plurality of left frames 63 at proper positions and each three of them are connected by an upright support 561 and both of the second lateral portion 52 and the second comer portion 54 are previously fixed to a plurality of fourth hydraulic presses 57 which are in turn fixed to a plurality of right frames 64 and each three of them are connected by a upright support 571 in the manner similar to the left side. When mounting the outer mold 50, first dispose the lower portion 55 under the lower flanges 14 and 15 of the body 10 in place between each pair of the second hydraulic presses 30', then engage the left and right frames 63 and 64 with the upper and lower frames 61 and 62 as illustrated in FIG. 5C. So that the lateral portion 51 and 52 and the corner portions 53 and 54 of the mold 50 are nearly placed at their proper position. This time, the third and the fourth presses 56 and 57 are operable to adjust both the lateral portions 51 and 52 and the corner portions 53 and 54 moving about transversely until the proper positions for them are decided as shown in FIG. 5D. Then a pair of end boards are adapted to block two ends of the body 10 (not shown) prior to grout the reinforcement-concrete into the spaces between mold 50 and the body 10. A third step begins when the concrete inside the mold 50 is completely cured in approppriate strength. This step is the disengagement of the mold 50 and the hydraulic presses 30 and 30' with the concreted cantilever prestressed beam. First of all is to disengage the lateral portions 51 and 52 together with the corner portions 53 and 54 by removal of the left and right frames 63 and 64. Secondly release the first hydraulic presses 30 from the upper flanges 11 and 12 of the beam by unfastening the screws 311 and releasing the hydraulic pressure in the presses 30. Note that unfastening of the screws 311 is very easier because of the adaption of the first and second retaining rings 121*a* and 121*b*, thirdly release the second hydraulic presses 30' from the lower flanges 14 and 15 of the beam the manner as recited for the releasing of the first hydraulic presses 30. So that the cantilever prestressed beam 10 is removable from the working site. It is understood that this cantilever prestressed beam comprises the beam resilient force along its Z axis and flange resilient force along its Y axis which is the main object of the present invention of providing the twin axis prestress in a cantilever prestressed beam. When it is adapted to build up a bridge, the pressure and tension caused by the traffic load shall be offset by these resilient forces for which can effectively obviate the slab of a bridge on load from downward deflection and elongate the span of the bridge as well as the spaces between the beams.

Figures 8, 8A, 8B:
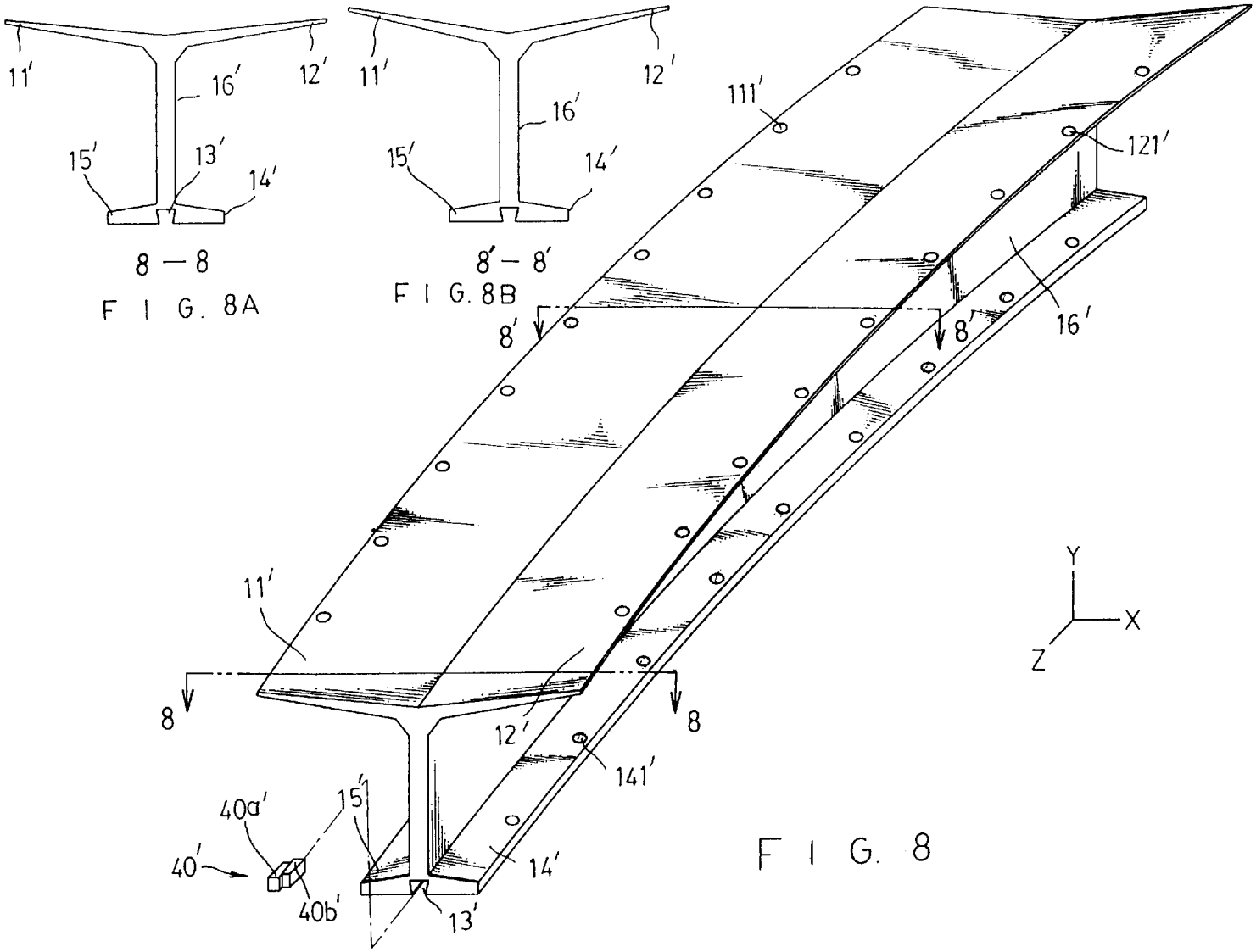
FIG. 8 is a perspective view to show an alternative preferred embodiment of a steel skeleton of simple-support prestressed beam according to the present invention.
FIG. 8A is a section taken along line 8—8 of FIG. 8.
FIG. 8B is a section taken along line 8'—8' of FIG. 8, FIGS. 9 and 9A are the elevational views illustrating the application of hydraulic presses to the steel skeleton of the simple-support prestressed beam of the present invention.

Referring to FIGS. 8, 8A, 8B and 9, 9A, an alternative embodiment is provided. FIGS. 8, 8A and 8B, show a steel skeleton of a simple-support prestressed beam and includes a slightly upward arcuate elongate steel body 10' of a roughly Y-shaped section, a pair of upper flanges 11' and 12' laterally extended from the top of an arcuate upright portion 16' along the length of the body 10' and slightly upward tilted wherein the flanges 11' and 12' at middle portion are more tilted than that abutting two ends of the body 10', a plurality of first spot face holes 111' and 121' extended spaced apart along the length and near the outward lateral edges of the upper flanges 11' and 12', a pair of lower flanges 14' and 15' which are narrower than the upper flanges 11' and 12', laterally extended from the lower end of the upright portion 16' and each including a flat bottom and a sloped upper surface, a plurality of second spot face holes 141' and 151' extended spaced apart along the length adjacent the outward lateral edges of the lower flanges 14' and 15' and positioned alternately with the first spot face holes 111' and 121', an elongate rectangular groove 13' centrally extended along the length of the body 10' and centered between the pair of the lower flanges 14' and 15' and a plurality of pairs of wedge means 40A' and 40B' provided for inserting into the groove 13' with pair off. The wedge means 40A' and 40B' each has a camming surface toward each other so that each pair of the wedge means 40A' and 40B' can be combined into a rectangular block which has the width equal to that of the groove 13'.

Figure 9:
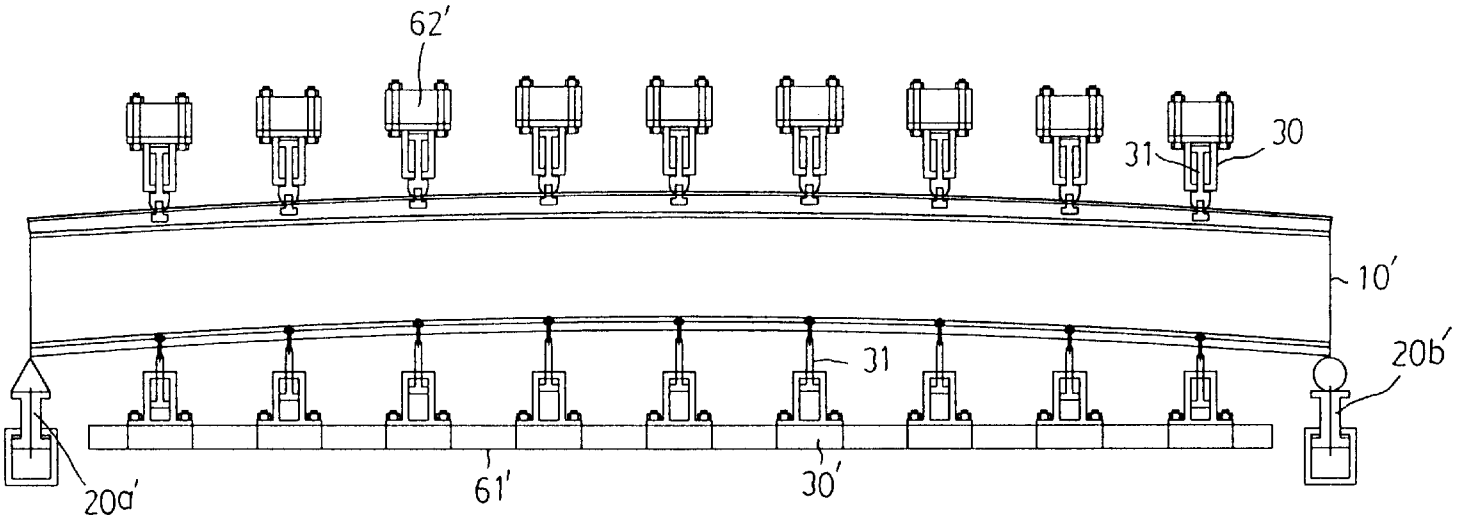
Figure 9A:
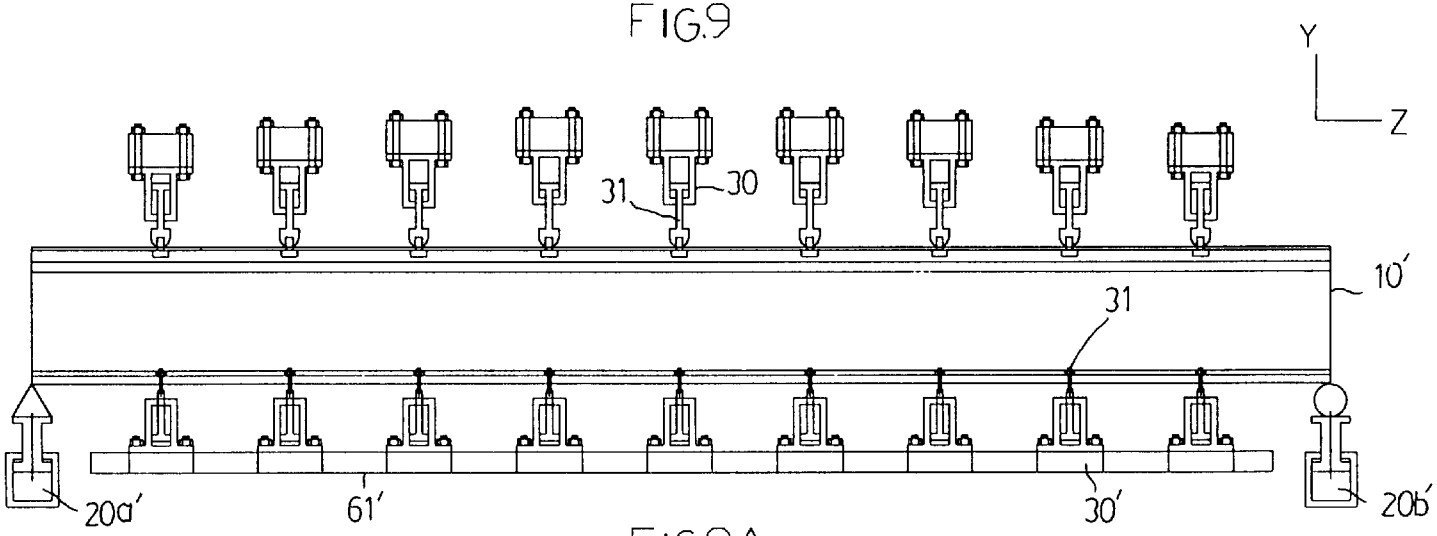

The process of construction of a simple-support prestressed beam is similar to that of the cantilever prestressed beam and scribed as follows:

First, parallel place the steel body 10' on a pair of hydraulic supports 20A' and 20B' which are positioned abutting two ends of the body 10' and previously secured to the base of the working site. The structure of the hydraulic supports 20A' and 20B' are identical to the hydraulic supports 20A and 20B and at the positions corresponding to that of the piers or abutments of a bridge. Then secure a plurality of the second hydraulic presses 30' to the top of an elongate lower frame 61' which extends under the steel body 10' between the hydraulic supports 20A' and 20B' and previously secured to the base of the working site (as shown in FIG. 9). The second hydraulic presses 30' which are the same structure as recited in the above embodiment dispose spaced apart with pair off each has a plunger means 31' connected to each of the second spot face holes 141' and 151' of the lower flanges 14' and 15' respectively in the manner same as recited in the above embodiment also. Secondly secure the first hydraulic presses 30 which are identical to that of the above embodiment to a plurality of the upper frames 62' and to the first spot force holes 111' and 121' of the upper flanges 11' and 12' in the manner as recited in the above embodiment either. The operational process to construct a simple-support presstressed beam is similar to that as described in the first embodiment and the discussions are applicable in the most instances. However, when the first step which is to apply the pressure to the flanges 111', 121', 141' and 151' is finished, the upper flanges 111' and 121' became flat and the upward arcuate body 10' of the steel skeleton became nearly straightened as shown in FIG. 9A. Then the wedge means 40A' and 40B' are frictionally secured in the elongate rectangular groove 13' and fixed by welding means. Other steps such as mounting the outer mold, grouting the concrete and the removal of mold as well as the hydraulic presses 30 and 30' are similar to that as described in the first embodiment. When the concrete is cured, the originally arcuate body 10' of the steel skeleton which is now straightened shall exert centrally arcuate prestress if it is applied to build up a bridge. The prestress includes the resilient force of the upper flanges 11' and 12' along the XY plane and the resilient force of the steel body along the Z direction (as shown in FIG. 8 ), which will offset the downward deflection of the bridge on traffic load and thus elongate the span of the bridge.

Figure 10:
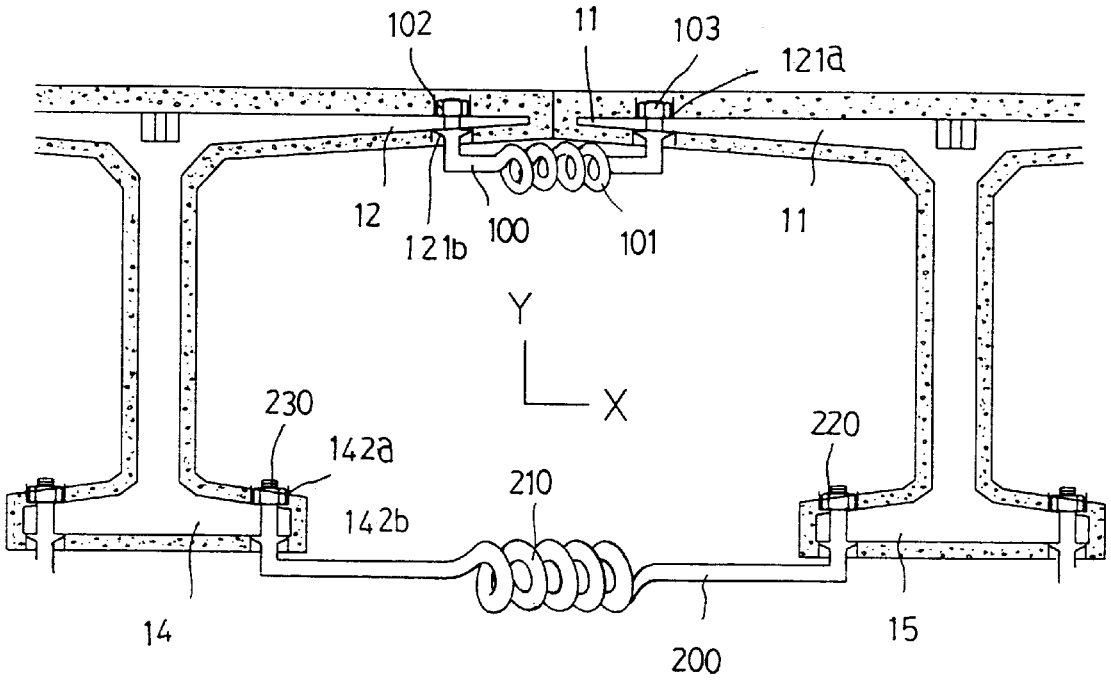
FIG. 10 is an elevational view illustrating the connection of the beams with the retching links.

Referring to FIG. 10, when the prestressed beams of the present invention are juxtaposedly disposed to a bridge, a pair of first and second U-shaped stretching links 100 and 200 are adaptable to connect between adjacent beams 10 or 10'. The links 100 and 200 each has a spring means 101 and 210 at the middle of the transverse portion and threaded ends 102 and 220 at two lateral portions of the U-shaped. The first stretching link 100 is shorter then the second stretching link 200 but higher than the second stretching link 200 so as to fit with the situation between the upper flanges 11 and 12. Therefore, the size of the second stretching link 200 is made to fit with the situation between the lower flanges 14 and 15 of the adjacent beams. The connection of the stretching links 100 to the flanges of the beams is very easy because the lateral portions of the first U-shaped stretching link 100 are inserted through the first and second retaining rings 121*a* and 121*b* of the upper flanges 11 and 12 and fastened by nut 103 and whereas the lateral portions of the second U-shaped stretching link 200 are inserted through the third and fourth retaining rings 142*a* and 142*b* of the lower flanges 14 and 15 of adjacent beams and fastened by nut 230. Since the spring means 101 and 210 provide certain elasticity at the middle of the transverse portions of the U-shaped stretching links 100 and 200, it enhances the shock-proof capability for a bridge.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A twin-axis prestressed single-tee beam comprising: a steel skeleton of a cantilever prestressed beam comprising a steel body of Y-shaped section, a flat elongate erect web having a straight upper edge and a bowed lower edge, a pair of upper flanges laterally extending from along the straight upper edge transversely sloped upward in a predetermined inclination wherein the inclination at two ends of the flange is greater than that at middle portion thereof and each of the flanges having a plurality of first spot face holes extending spaced apart near outward lateral edges thereof, a pair of lower flanges which are narrower than the upper flanges laterally extending outward from the bowed lower edge of the web along the length thereof each having a sloped upper surface and a plurality of second spot face holes extending spaced apart near outward edges thereof, an elongate rectangular groove centrally extending between the upper flanges and along the length thereof, and a plurality of pairs of wedge means inserted frictionally into the elongate rectangular groove, said wedges means each having a camming surface facing each other so that each pair of said wedge means comprise a rectangular configuration.

2. The prestressed beam as recited in claim 1 wherein said first hydraulic support includes a hinge upper end and said second hydraulic support includes a roller upper end.

3. The prestressed beam as recited in claim 1 wherein hydraulic presses are secured to a plurality of upper frames each including a threaded ball lower end and which secure to a plurality of lower frames of different heights each including a threaded cylinder upper end.

4. The prestressed beam as recited in claim 3 wherein said beam is made from an outer mold including a lower portion disposed between pairs of said hydraulic presses along the length of said steel skeleton, a pair of lateral portions and a pair of corner portions adjustably secured to a plurality of additional hydraulic presses respectively.

5. The prestressed beam as recited in claim 4 wherein said presses are transversely secured spaced apart to a pair of lateral frames respectively along the length of said outer mold and each three of said presses being supported by an upright means.

6. The prestressed beam as recited in claim 1 further includes a pair of first and second U-shaped stretching links each having a spring means at a middle of a transverse portion and threads at ends of two lateral portions with the transverse portion of said first U-shaped stretching link-shorter than that of said second U-shaped stretching link and the two lateral portions higher than that of said second U-shaped stretching link.

7. The prestressed beam as recited in claim 6 wherein said first U-shaped stretching link connects between adjacent upper flanges of a pair of said cantilever prestressed beams with two lateral portions thereof inserting into the first spot face holes of the adjacent upper flanges therethrough and fastened by a pair of nuts with the first and second retaining rings remaining thereinbetween.

8. The prestressed beam as recited in claim 6 wherein said second U-shaped stretching link connects between the adjacent lower flanges of a pair of said cantilever prestressed beams with two lateral portions thereof inserting into the second spot face holes of the adjacent lower flanges of therethrough and fastened by a pair of nuts with the first and second retaining rings remaining thereinbetween.

9. A method of construction utilizing the beam as claimed in claim 1 comprising the following process:

first, disposing said steel skeleton parallel to a working site and supporting with a pair of first and second hydraulic supports at a center position;

secondly, applying a plurality of said hydraulic presses to each of the first spot face holes of said upper flanges and fastening by a round head screw and a nut with a pair of first and second retaining rings embedded in upper and lower ends of the first spot face holes therebetween; and applying a plurality hydraulic presses to each of the second spot face holes of said lower flanges and fastening by a threaded pin and a nut with a pair of third and fourth retaining rings embedded in upper and lower ends of the second spot face holes therebetween;

thirdly, applying predetermined hydraulic pressure by said hydraulic supports and said hydraulic presses to force said upper flanges of the upright of said skeleton becoming flat and the bowed lower edge of said upright becoming nearly straightened and then inserting and welding said pairs of wedge means into said elongate rectangular groove;

fourthly, mounting an outer mold upon each outer surface of said steel skeleton and leaving a predetermined space therebetween and disposing a pair of block boards at two longitudinal ends of said steel skeleton;

fifthly, arranging reinforcements and grouting concrete into the space between said steel skeleton and said outer mold; and sixth, removing sequentially said outer mold, said presses and said first and second supports from said cantilever prestressed beam after that the concrete is cured.

10. A twin-axis prestressed single-tee beam comprising:

a steel skeleton of a simple-support prestressed beam comprising an elongate steel body of Y-shaped section, a flat elongate web of slightly upward bowed cross section, a pair of upper flanges laterally extending from a top of the web along the length thereof and transversely sloped upward in a predetermined inclination wherein the inclination middle portion of the flange is greater than that at the end portions thereof and each of the flanges having a plurality of first spot face holes extending spaced apart near outward lateral edges, a pair of lower flanges which are narrower than the upper flanges laterally extending from a bottom of the web along the length thereof each having a sloped upper surface and a plurality of second spot face holes extending spaced apart near outward lateral edges thereof, an elongate rectangular groove centrally extending between the lower flanges and along the length thereof, and a plurality of pairs of wedge means inserted frictionally into the elongate rectangular groove, said wedge means each having a camming surface facing each other so that each pair of said wedge means combine a rectangular configuration.

11. The prestressed beam as recited in claim 10 wherein said beam includes a first hydraulic support including a hinge upper end and a second hydraulic support includes a roller upper end.

12. The prestressed beam as recited in claim 10 wherein hydraulic presses are secured to a plurality of upper frames and each including a threaded ball lower end and which secure to a lower frame with pair off and each including a threaded cylinder upper end.

13. The prestressed beam as recited in claim 12 wherein said beam is made from an outer mold includes a lower portion disposed between pairs of said adjacent hydraulic presses along the length of said steel skeleton, a pair of lateral portions and a pair of corner portions adjustably secured to a plurality of additional hydraulic presses respectively.

14. The prestressed beam as recited in claim 13 wherein said presses are transversely secured spaced apart to a pair of lateral frames respectively along the length of said outer mold and each three of said presses being supported by an upright means.

15. The prestressed beam as recited in claim 10 further includes a pair of first and second U-shaped stretching links each having a spring means at a middle of a transverse portion and threads at ends of two lateral portions with the transverse portion of said first U-shaped stretching link shorter than that of said second U-shaped stretching link and the two lateral portions higher than that of the second U-shaped stretching link.

16. The prestressed beam as recited in claim 15 wherein said first U-shaped stretching link connects between adjacent upper flanges of a pair of said simple-support prestressed beams with two lateral portions thereof inserting into the first spot face holes of the adjacent upper flanges therethrough and fastening by a pair of nuts with the first and second retaining rings remaining thereinbetween.

17. The prestressed beam as recited in claim 15 wherein said second U-shaped stretching link connects between adjacent lower flanges of a pair of said simple-support prestressed beams with two lateral portions thereof inserting into the second spot face holes of the adjacent lower flanges therethrough and fastened by a pair of nuts with the third and fourth retaining rings remaining thereinbetween.

18. A method of construction utilizing the beam as claimed in claim 10 comprising the following process:

first, disposing said steel skeleton parallel to a working site and supporting with a pair of first and second hydraulic supports adjacent two ends thereof;

secondly, applying a plurality of said hydraulic presses to each of the first spot face holes of said upper flanges and fastening by a round head screw and a nut with a pair of first and second retaining rings embedded in upper and lower ends of the first spot face holes therebetween; and applying a plurality hydraulic presses to each of the second spot face holes of said lower flanges and fastening by a threaded pin and a nut with a pair of third and fourth retaining rings embedded in the upper and lower ends of the second spot face holes therebetween;

thirdly, applying predetermined hydraulic pressure by said hydraulic supports and said hydraulic presses to force said upper flanges becoming flat and the upright of said steel skeleton becoming nearly straightened and then inserting and welding said pairs of wedge means into the elongate rectangular groove;

fourthly, mounting an outer mold upon each outer surface of said steel skeleton and leaving a predetermined space therebetween and disposing a pair of block boards at two ends of said steel skeleton;

fifthly, arranging reinforcements and grouting concrete into the space between said steel skeleton and said outer mold; and sixth, removing sequentially said outer mold, said presses and said first and second supports from said simple-support prestressed beam after that the concrete is cured.

* * * * *